US006498324B2

(12) United States Patent
Yamamoto et al.

(10) Patent No.: US 6,498,324 B2
(45) Date of Patent: Dec. 24, 2002

(54) INDUCTION HEATING DEVICE FOR ROLLING ROLLER AND METHOD OF INDUCTION HEATING

(75) Inventors: Mikio Yamamoto, Hiroshima-ken (JP); Tatsufumi Aoi, Hiroshima-ken (JP); Keiji Mizuta, Hiroshima-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/976,085

(22) Filed: Oct. 15, 2001

(65) Prior Publication Data

US 2002/0092846 A1 Jul. 18, 2002

(30) Foreign Application Priority Data

Jan. 15, 2001 (JP) ..... 2001-006870

(51) Int. Cl.[7] ..... H05B 6/14; H05B 6/06

(52) U.S. Cl. ..... 219/602; 219/619; 219/661; 219/663; 72/29.1; 72/202; 148/567

(58) Field of Search ..... 219/619, 661, 219/662, 663, 665, 669, 667, 668, 602, 635; 399/330, 328, 339, 336, 337; 72/29.1, 29.2, 28.2, 28.1, 202; 148/567, 570

(56) References Cited

U.S. PATENT DOCUMENTS 4,309,586 A * 1/1982 Ishibashi ..... 219/665
4,595,813 A * 6/1986 Chausse et al. ..... 219/649
4,653,395 A * 3/1987 Verkasalo ..... 100/93 R
5,778,293 A * 7/1998 Ohtsuka ..... 219/619
5,990,464 A * 11/1999 Hino et al. ..... 219/602
6,122,477 A * 9/2000 Parker ..... 399/330

FOREIGN PATENT DOCUMENTS

JP 2996013 * 12/1999
JP 2000-225406 * 8/2000

* cited by examiner

*Primary Examiner*—Philip H. Leung
(74) *Attorney, Agent, or Firm*—Birch, Stewart, Kolasch & Birch, LLP

(57) ABSTRACT

An induction heating device is disclosed for heating a rolling roller by induction heating so as to equalize the diameter of the rolling roller. The device includes an induction heater and a means for moving the induction heater to a portion of the roller surface to be heated, while the distance from the induction heater to the surface is maintained constant. An electric power supply means supplies electric power to the induction heater, and a means is provided for adjusting the quantity of heat to be produced by the induction heater according to the quantity of heat that is required by the portion of the roller to be heated. The heat quantity adjusting means includes a frequency control means for controlling the frequency of electric power supplied to the induction heater, wherein the frequency control means adjusts the frequency of electric power within a predetermined frequency range to a frequency which is suitable to produce the quantity of heat required by the portion of the rolling roller to be heated. The greater the amount of heating that is required, the higher the frequency utilized. Preferably, the frequency is adjusted within a range of from about 25 to about 200 kHz.

24 Claims, 6 Drawing Sheets

INDUCTION HEATING DEVICE FOR ROLLING ROLLER AND METHOD OF INDUCTION HEATING

BACKGROUND OF THE INVENTION

1. Field of the Invention

The present invention relates to an induction heating device and a method of induction heating. More particularly, the present invention relates to an induction heating device and a method of induction heating used for local heating of a rolling roller of a rolling mill.

2. Description of the Related Art

In general, in a hot rolling process, a temperature difference occurs between a portion of a rolling roller in the roller width direction in which a rolled sheet passes and a portion of the rolling roller in the roller width direction in which the rolled sheet does not pass. Therefore, a difference in the roller diameter is caused in the roller width direction by the difference in the thermal expansion of the roller. Therefore, a hot rolling mill, which use an induction heating device for locally heating a low temperature portion of the rolling roller under the condition of non-contact so that the thermal expansion of the rolling roller can be kept constant in the roller width direction, was developed, as disclosed, for example, in JP2000-225406.

FIG. 7 is a schematic illustration showing an outline of a sheet rolling mill provided with a conventional induction heating device. In the sheet rolling mill, there are provided a pair of work rollers 1, 2 which are arranged opposed to each other. Also, there are provided a pair of backup rollers 3, 4 which are arranged in an upper and a lower portion. The sheet 5 to be rolled is inserted between the work rollers 1, 2 and hot-rolled and drawn out in the direction of arrow X. In this process of hot-rolling, the work rollers 1, 2 are thermally expanded by the heat of the sheet 5 to be rolled. Therefore, what is called a heat-crown is generated in which the roller diameter distribution in the roller axis direction becomes maximum at the center of the roller axis.

When hot-rolling is continued under the condition where a heat-crown is generated, the sheet thickness becomes unequal, and the quality of the rolled sheet deteriorates. In order to solve the above problems associated with a heat-crown, there are provided four induction heaters 6 on the delivery side (alternatively on the entry side) of the work rollers 1, 2 in such a manner that the induction heaters 6 can slide on the sliding rails 7 which are arranged in parallel with the axes of the work rollers 1, 2, while the induction heaters 6 are arranged opposed to the work rollers 1, 2. These induction heaters 6 are supplied with electric power by the electric power source unit 8'.

As shown in FIG. 8, each induction heater 6 is composed as follows. In a hollow portion of the coil 61, for example, there are provided ferromagnetic body cores 62 (ferrite), the profile of each of which is a rectangular parallelepiped, and also there are provided water-cooled plates 63 to cool the cores, wherein the ferromagnetic body cores 62 and the water-cooled plates 63 are alternately arranged in contact with each other. Cooling water is supplied from the cooling water supply unit 66 to each water-cooled plate 63 via the pipes 65, 64. Using the above structure, the occurrence of overheating caused by heat generated by the coil 61 and the ferromagnetic body cores 62 can be prevented.

This induction heating device reads the width of the sheet, reads the temperature of the sheet, reads a target profile of the rolled sheet, estimates current and future roller profile and controls the heating quantity and the heating position of the rollers so that an optimum sheet profile can be obtained after rolling.

In the above apparatus of the prior art, the quantity of heat given by the induction heater 6 is controlled when an electric current or voltage is controlled by the electric power supply unit 8', and the frequency of electric power is not controlled. Therefore, the following problems may be encountered.

(1) When the frequency of electric power supplied to the coil 61 is low, the electric current generated on the surface of a roller penetrates into a deep portion of the roller. Therefore, not only the surface of the rolling roller 1, 2 but also the inside is heated. As a result, the heating density is lowered. Accordingly, the heating efficiency, which is necessary for correcting the thermal expansion of the rolling roller 1, 2, is lowered. Further, since the magnetic flux density in the core 62 tends to increase when the frequency is low, the size of the induction heater 6 necessary for obtaining a predetermined quantity of heat is increased.

(2) On the other hand, when the frequency of electric power supplied to the coil 61 is high, the high frequency loss of a feeder is increased, as is the loss of a matching circuit including the core 62, and the voltage impressed upon the coil. As a result, the electric power transmission efficiency is lowered and electric breakdown tends to occur due to the high voltage.

(3) Electric power outputted from the electric power supply unit 8' is adjusted by adjusting the electric current or voltage. Therefore, it is not possible to reduce the size of the electric power supply unit 8' significantly.

SUMMARY OF THE INVENTION

It is an object of the present invention to provide an induction heating device for heating a rolling roller by induction heating and a method of induction heating by which the diameter of the rolling roller can be stably equalized.

According to the present invention, there is provided an induction heating device for heating a rolling roller by induction heating so as to equalize the diameter of the rolling roller, comprising:

an induction heater; an induction heater moving means for moving the induction heater to a heating portion while a distance from the induction heater to the surface of a portion to be heated is kept constant; an electric power supply means for supplying electric power to the induction heater; and a heat quantity adjusting means for adjusting the quantity of heat of the induction heater according to the quantity of heat required by the heating portion, the heat quantity adjusting means including a frequency control means for controlling the frequency of electric power supplied to the induction heater, wherein the frequency control means adjusts the frequency of electric power to be high in a predetermined frequency range when the quantity of heat required by the heating portion is large, and adjusts the frequency of electric power to be low when the quantity of heat required by the heating portion is small.

According to the present invention, there is also provided an induction heating method of heating a rolling roller by an induction heating device so as to equalize the diameter of the rolling roller, the induction heating device comprising: an induction heater; an induction heater moving means for moving the induction heater to a heating portion while the distance from the induction heater to the surface of a portion to be heated is kept constant; an electric power supply means for supplying electric power to the induction heater; and a heat quantity adjusting means for adjusting the quantity of heat of the induction heater according to the quantity of heat required by the heating portion, the induction heating method comprising the steps of: adjusting the frequency of electric power to be high in a predetermined frequency range by the frequency control means when the quantity of heat required by the heating portion is large; and adjusting the frequency of electric power to be low by the frequency control means when the quantity of heat required by the heating portion is small.

The present invention can be more fully understood from the description of preferred embodiments of the invention set forth below, together with the accompanying drawings.

DESCRIPTION OF THE PREFERRED EMBODIMENTS

Figure 1:
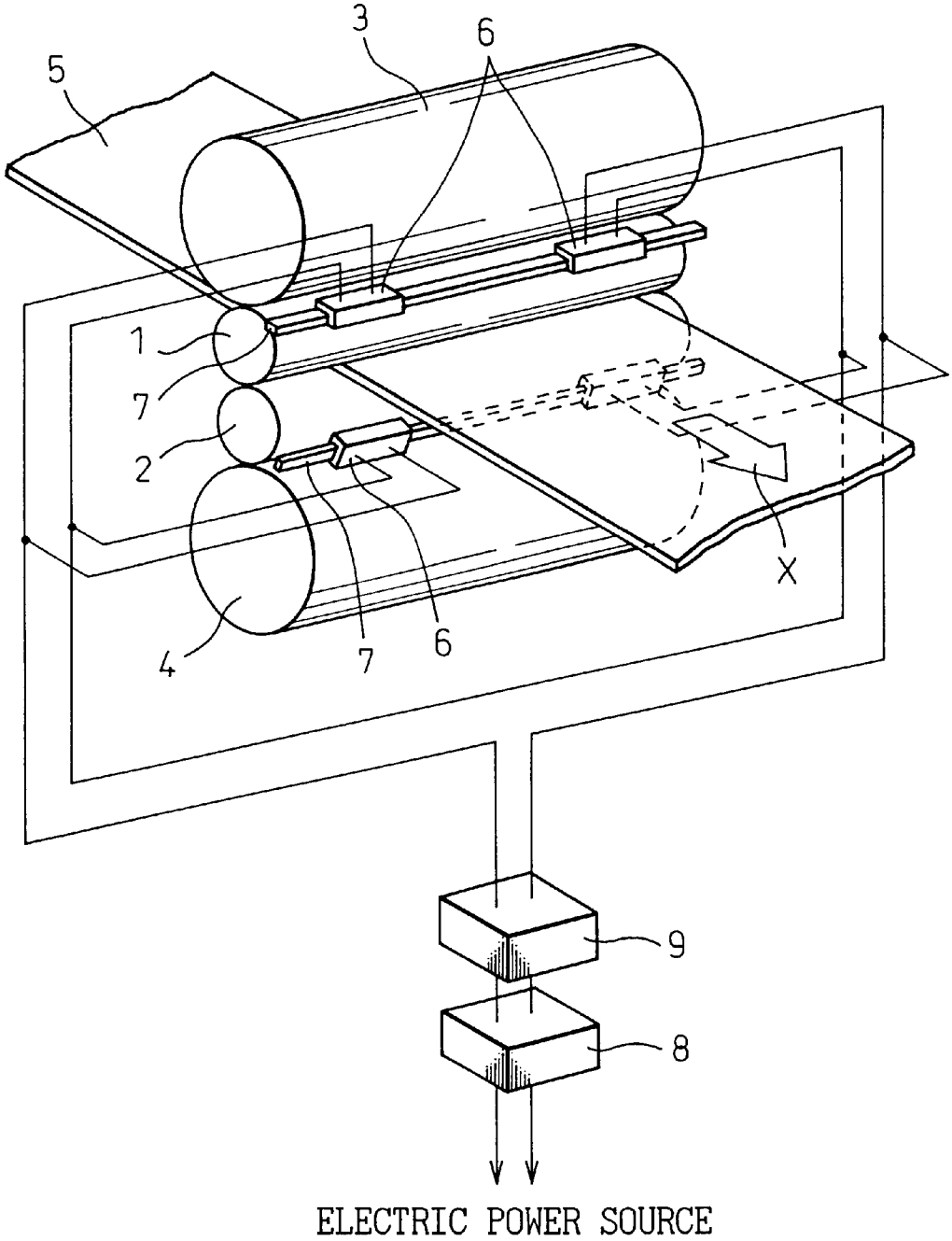
FIG. 1 is a schematic illustration for explaining an outline of an induction heating device of the present invention.
Figure 7:
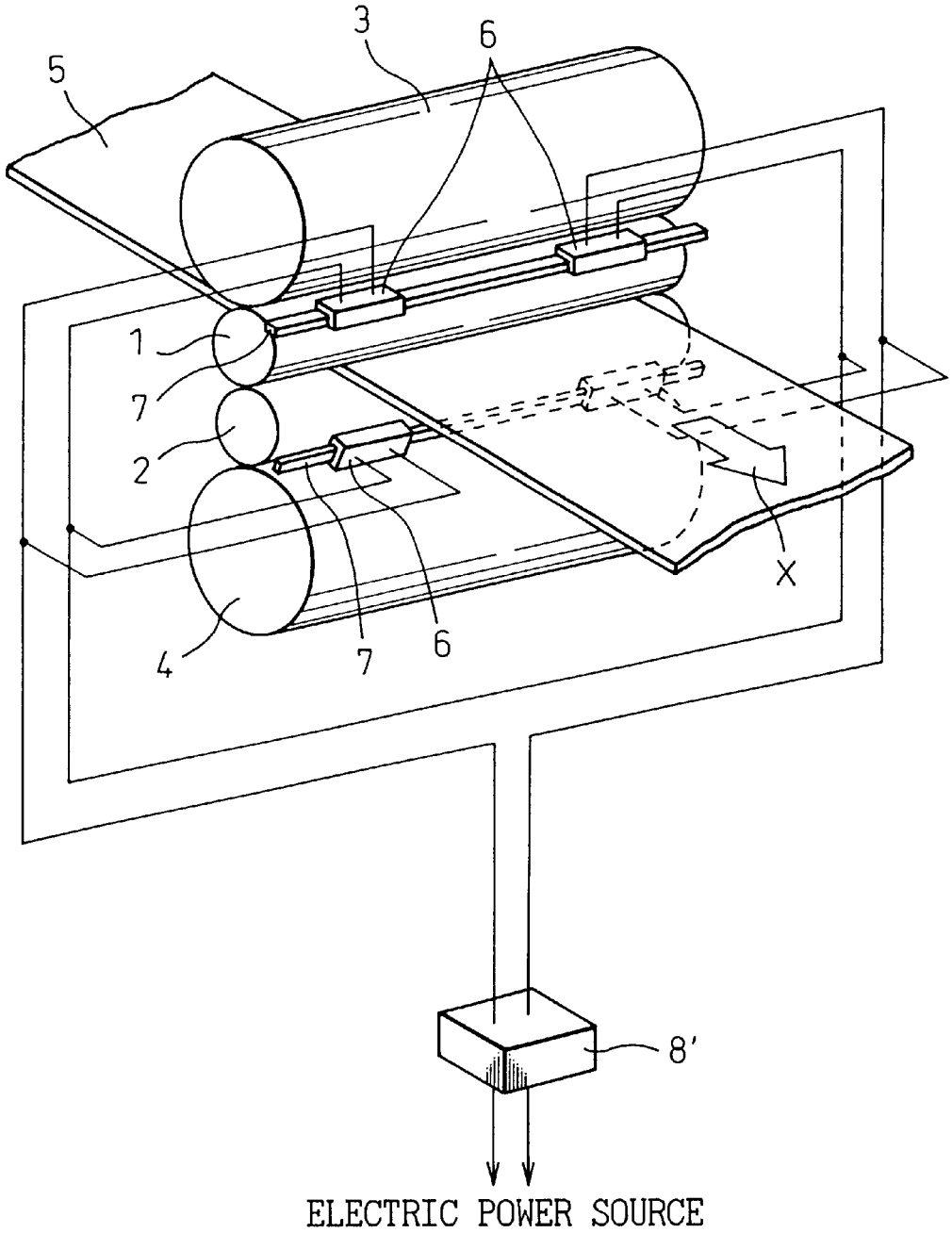
Fig.7 PRIOR ART
FIG. 7 is a schematic illustration for explaining an outline of an induction heating device of the prior art.
Figure 8:
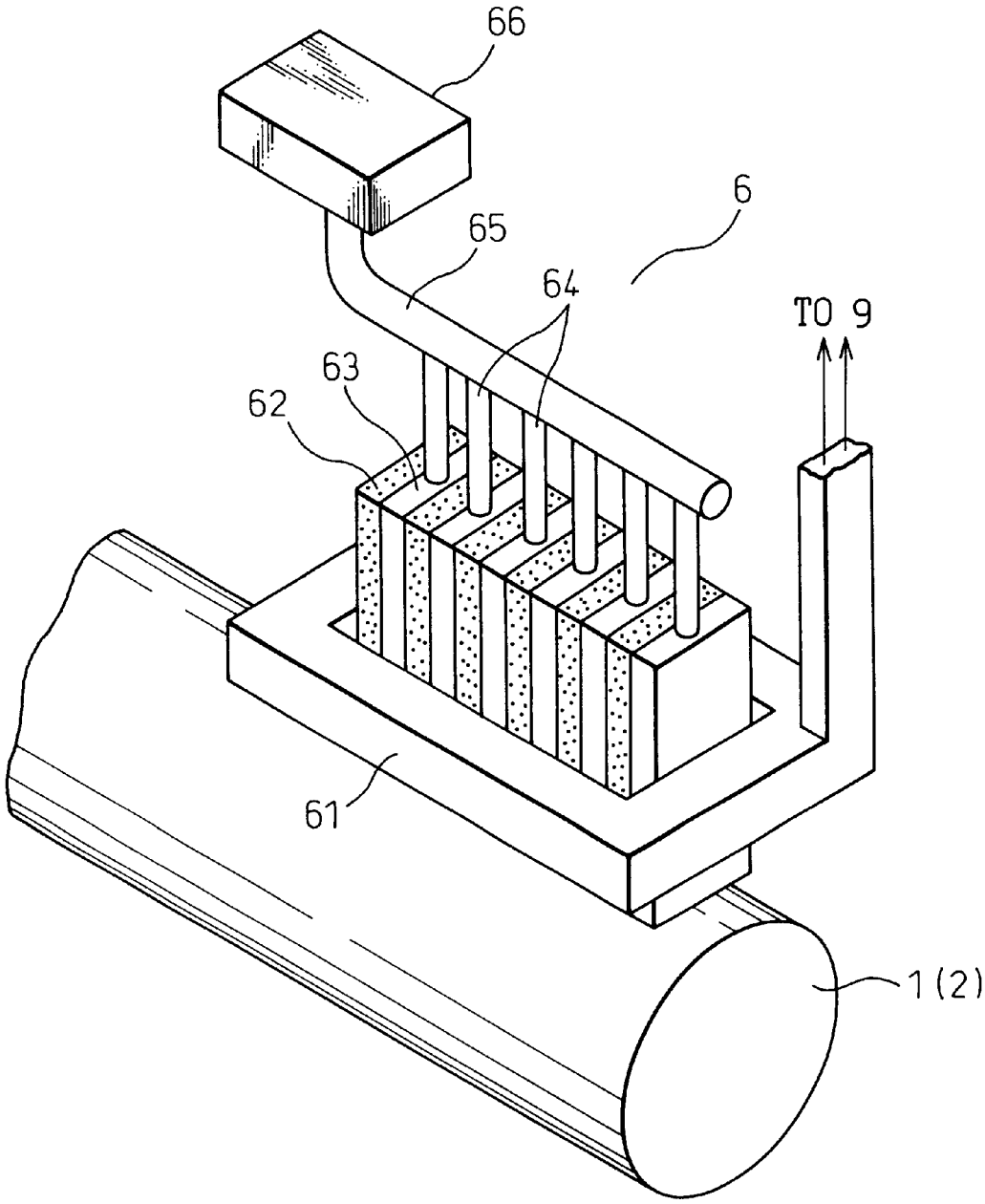
Fig.8 PRIOR ART
FIG. 8 is a perspective view showing the detail of the induction heater shown in FIG. 7.

FIG. 1 is a schematic illustration for explaining an induction heating device for a rolling roller of the present invention. The essential structure of this induction heating device is the same as that of the prior art shown in FIG. 7. There are provided four induction heaters 6 on the delivery side (entry side) of the work rollers 1, 2 in such a manner that the induction heaters 6 can slide on the sliding rails 7 which are arranged in parallel with the axes of the work rollers 1, 2, while the induction heaters 6 are arranged opposed to the work rollers 1, 2. These induction heaters 6 have the same structure as that of the prior art and are supplied with electric power by the electric power source 8.

However, this electric power supply unit 8 is different from the electric power supply unit 8' of the prior art, in that the electric power to be supplied to the induction heaters 6 is not adjusted, but an approximately constant intensity of electric power is supplied. Between the electric power supply unit 8 and the induction heaters 6, there is provided a frequency control unit 9 for adjusting the frequency of electric power that the electric power unit 8 supplies.

Concerning the frequency control unit 9, it is possible to adopt a system in which the oscillating frequency of a fixed frequency oscillator is controlled. Also, it is possible to adopt a system in which a resonance circuit is composed according to a load impedance and the resonance frequency is controlled by a condenser. Either system may be adopted.

In this connection, electric current penetration depth $\delta$ (m) in the case where an induction current flows in a conductor is expressed by the following expression (1), $$\delta=(\rho/\pi f\mu)^{1/2} \quad (1)$$

where $\rho$ is specific resistance ($\Omega$/m), f is frequency (Hz) of an electric current flowing in a coil, and $\mu$ is magnetic permeability (H/m).

According to the expression (1), when the frequency f is increased, the electric current penetration depth $\delta$ is decreased.

Therefore, in the case where the same intensity of electric power is supplied, the higher the frequency is, the more the heating is concentrated on a small region on the surface layer of the work roller 1, 2, so that the heating density can be increased.

Experimentally, when the electric current penetration depth is not more than 150 $\mu$m, preferably when it is not more than 100 $\mu$m, it is possible to provide a roller deformation prevention effect. According to the relation of the frequency f with the electric current penetration depth $\delta$ shown in FIG. 2, it necessary that the frequency f be not less than 25 kHz, and preferably that the frequency f be not less than 50 kHz.

In order to correct the thermal expansion of the work roller 1, 2, it is necessary to concentrate the same heating density as that of the sheet 5, which is rolled, upon the surface of the work roller 1, 2.

Figure 3:
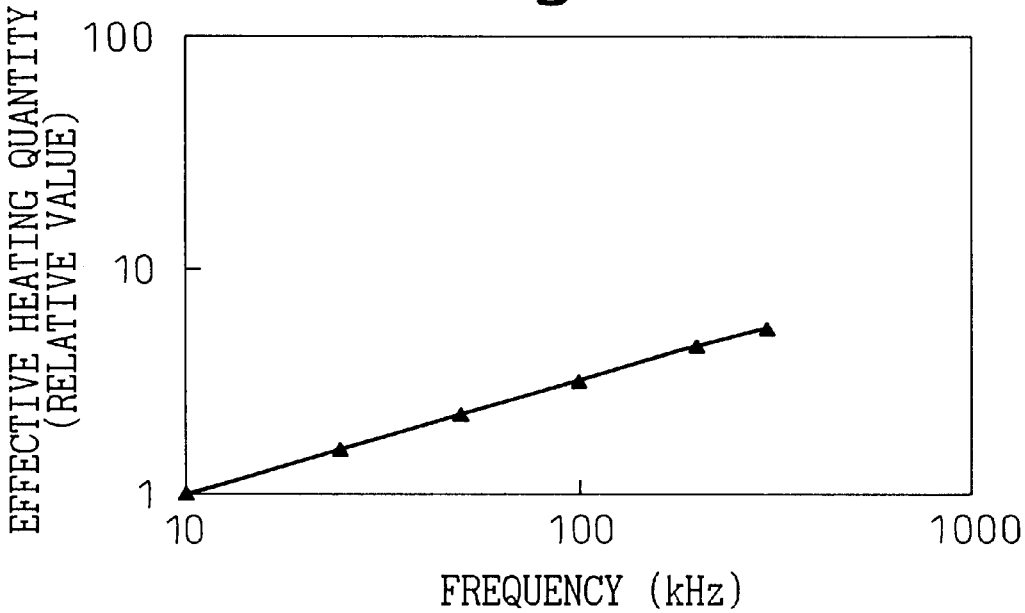
FIG. 3 is a graph showing a relation of the frequency with an effective quantity of heat of a roller by a relative value compared to 1 set for the case when the frequency is 10 kHz.

In FIG. 3, a relation of the frequency with the effective heat quantity of a roller is shown by a relative value. In this case, when the frequency is 10 kHz, each value is set at 1. The following can be understood from FIG. 3. When the frequency f of electric power supplied to the high frequency coil 61 is increased, the heat quantity effective for correcting the thermal expansion of the work roller 1, 2 can be increased. Therefore, it is possible to reduce the cross-sectional area of the ferromagnetic body core. Accordingly, the heating efficiency can be enhanced.

When a predetermined magnetic flux is made to act on a roller, the necessary minimum cross-sectional area for preventing the core from magnetic saturation is in inverse proportion to the frequency. Accordingly, when the frequency is increased, it becomes possible to make the induction heating device including the core compact.

Figure 4:
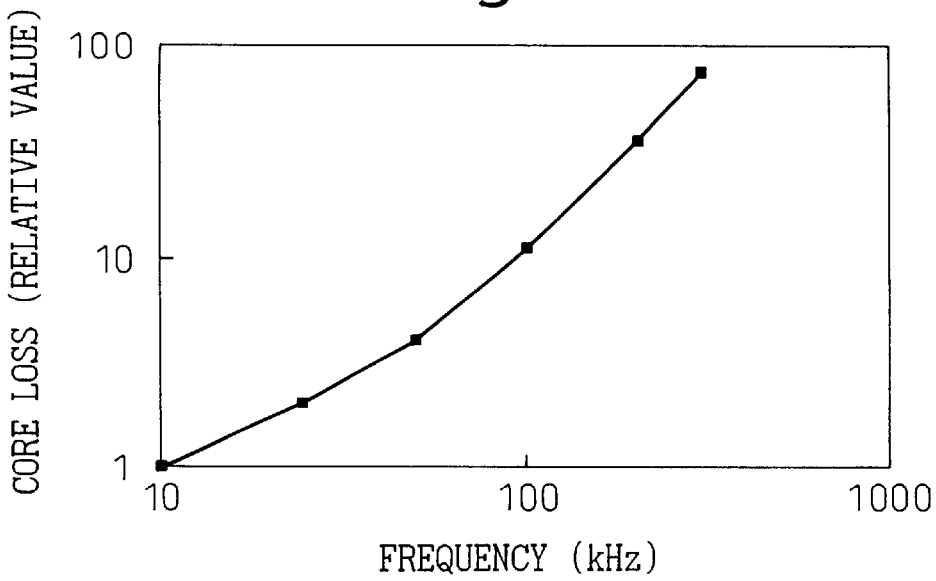
FIG. 4 is a graph showing a relation of the frequency with a core loss by a relative value compared to 1 set for the case when the frequency is 10 kHz.

However, in FIG. 4, a relation of the loss with respect to the frequency is shown by a relative value. In this case, when the frequency is 10 kHz, each value is set at 1. The following can be understood from FIG. 4. When the frequency f is increased, the core loss is increased more than an increase in the effective heat quantity. Therefore, it is preferable that the frequency f not be increased to too high a level.

Figure 5:
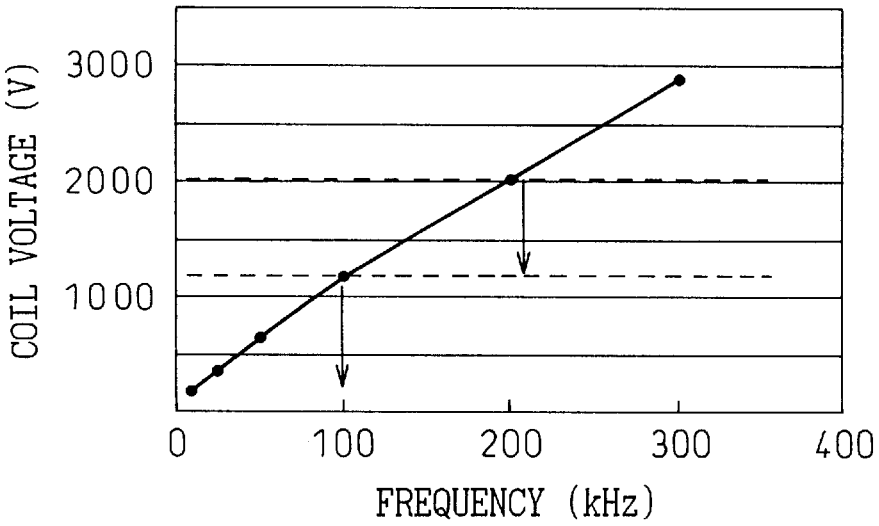
FIG. 5 is a graph showing a relation of voltage impressed upon a coil to the frequency.

On the other hand, voltage to be impressed upon the coil 61 is determined by coil inductance proportional to the frequency. As shown in FIG. 5, when the frequency f is increased, it becomes necessary to increase the voltage to be impressed. However, according to the voltage-resistance ability of the circuit element used for a common induction heating device, it is necessary that the impressed voltage be no higher than 2000 V and preferable that be no higher than 1200 V. When voltage higher than that is impressed, electric breakdown may occur.

Taking the above conditions into consideration, it is necessary that the frequency f be no more than 200 kHz, and preferable that it be no more than 100 kHz.

Figure 2:
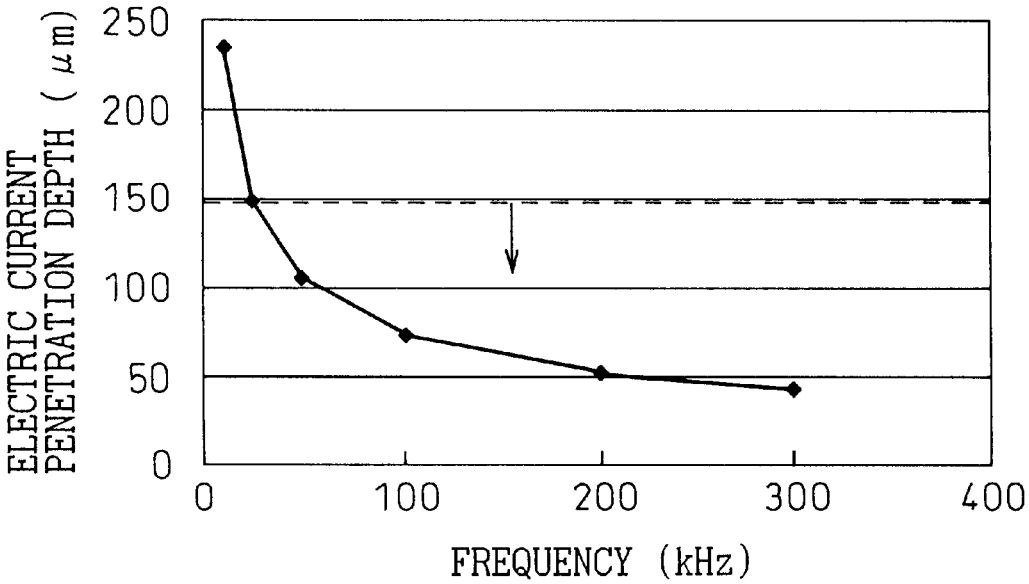
FIG. 2 is a graph showing calculated values of the penetration depth of electric current with respect to the frequency.

According to FIGS. 2 and 5, the following can be said. It is necessary that the frequency f of electric power impressed upon the induction heater 6 be in a range from 25 to 200 kHz, and preferable that it be in an appropriate range from 50 to 100 kHz.

Figure 6:
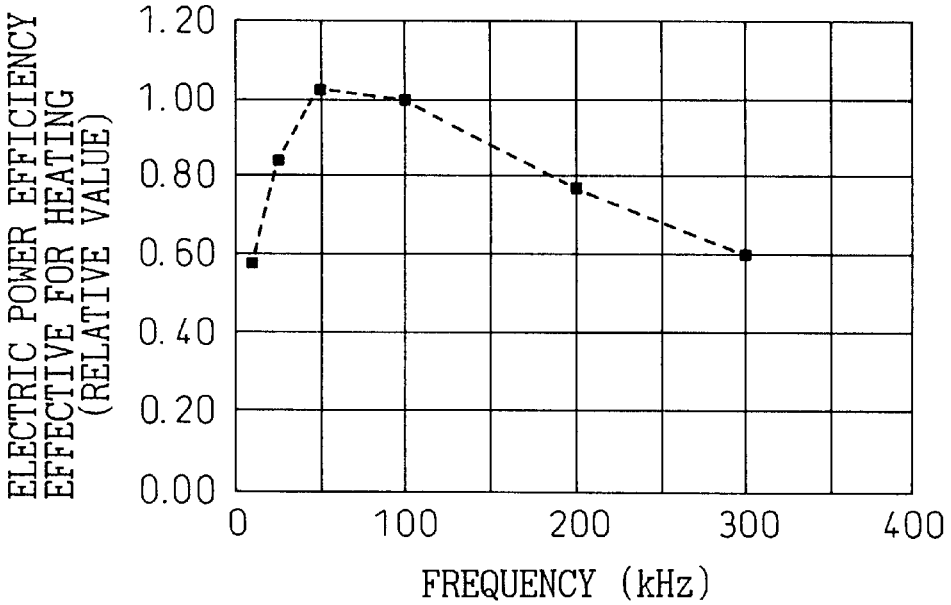
FIG. 6 is a graph showing a relation between the exciting frequency and the electric power efficiency effective for heating by a relative value compared to 1 set for the case when the frequency is 100 kHz.

FIG. 6 shows a relation between the frequency and the electric power efficiency by a relative value compared to 1 set for the case when the frequency is 100 kHz effectively used for heating. When the frequency f is kept in an appropriate range, the electric power efficiency is enhanced to a value of not less than 0.8. From the viewpoint of electric power efficiency, it is preferable that the frequency be kept in a range from 25 to 200 kHz, and more preferably in a range from 50 to 100 kHz.

For the above reasons, in the present invention, the frequency f of electric power impressed upon the coil of the induction heater 6 is controlled in a range from 25 to 200 kHz, and preferably in a range from 50 to 100 kHz. Therefore, it is possible to heat the work rollers 1, 2 at a high efficiency without increasing the size of the heating device. Further, there is no possibility of the occurrence of electric breakdown. When the temperature of the heating portion of the work roller 1, 2 is low and the required heat quantity is large, heating is conducted by electric power of high frequency. On the other hand, when the temperature of the heating portion of the work roller 1, 2 is not so low and the required heat quantity is small, heating is conducted by electric power of low frequency.

In the present invention, the heat quantity of the induction heater corresponding to the required heat quantity of the heating portion is controlled by the frequency control means such that the frequency is adjusted in a predetermined frequency range. In general, the frequency can be adjusted more easily than electric power, i.e. adjustment of the frequency can be more easily conducted than adjustment of the electric current and voltage. Therefore, the size of the device and its cost can be reduced.

What is claimed is:

1. An induction heating device for selectively heating a rolling roller of a rolling mill by induction heating so as to equalize the diameter of the rolling roller, comprising:

an induction heater; an induction heater moving means for moving the induction heater to a heating portion while a distance from the induction heater to a heating surface of a portion to be heated is kept constant; an electric power supply means for supplying electric power to the induction heater; and a heat quantity adjusting means for adjusting a quantity of heat of the induction heater according to a quantity of heat required by the heating portion, the heat quantity adjusting means for adjusting the quantity of heat including a frequency control means for adjustably controlling the frequency of the electric power that is supplied to the induction heater throughout a predetermined frequency range, wherein, when a quantity of heat is required to equalize the diameter of the portion of the rolling roller to be heated, the frequency control means adjusts the frequency of the electric power supplied to the induction heater within a predetermined frequency range that is suitable for supplying the needed quantity of heat through the induction heater into the portion of the rolling roller to be heated.

2. An induction heating device according to claim 1, wherein the greater the quantity of heat that is required to be supplied to the portion of the rolling roller to be heated, the higher the frequency of the electric power that is supplied to the induction heater.

3. An induction heating device according to claim 2, wherein the frequency control means adjusts the frequency of the electric power that is supplied to the induction heater within a range from about 25 to about 200 kHz.

4. An induction heating device according to claim 3, wherein the depth of heating of the surface of the rolling roller is about 150 $\mu$m or less.

5. An induction heating device according to claim 4, wherein the depth of heating of the surface of the rolling roller is about 100 $\mu$m or less.

6. An induction heating device according to claim 3, wherein the frequency control means adjusts the frequency of the electric power that is supplied to the induction heater within a range from about 50 to 100 kHz.

7. An induction heating method of selectively heating a rolling roller of a rolling mill by an induction heating device so as to equalize the diameter of the rolling roller, the induction heating device comprising: an induction heater; an induction heater moving means for moving the induction heater to a heating portion while a distance from the induction heater to the surface of a portion to be heated is kept constant; an electric power supply means for supplying the electric power to the induction heater; and a heat quantity adjusting means for adjusting a quantity of heat of the induction heater according to a quantity of heat required by the heating portion, the induction heating method comprising the steps of: adjusting the frequency of electric power supplied to the induction heater within a predetermined frequency range by the frequency control means to a frequency that is suitable for supplying the needed quantity of heat through the induction heater into the portion of the rolling roller to be heated.

8. An induction heating method according to claim 7, wherein the greater the quantity of heat that is required to be supplied to the portion of the rolling roller to be heated, the higher the frequency of the electric power that is supplied to the induction heater.

9. An induction heating method according to claim 8, wherein the frequency of the electric power that is supplied to the induction heater is adjusted within a range from about 25 to about 200 kHz by the frequency control means.

10. An induction heating method according to claim 9, wherein the depth of heating of the surface of the rolling roller is about 150 $\mu$m or less.

11. An induction heating method according to claim 10, wherein the depth of heating of the surface of the rolling roller is about 100 $\mu$m or less.

12. An induction heating method according to claim 9, wherein the frequency control means adjusts the frequency of the electric power that is supplied to the induction heater within a range from about 50 to 100 kHz.

13. An induction heating device for selectively heating a rolling roller of a rolling mill by induction heating so as to equalize the diameter of the rolling roller, comprising:

an induction heater;

a means for moving the induction heater in an axial direction along the rolling roller to a portion thereof that is to be heated while maintaining the distance of the induction heater from the surface of the rolling roller substantially constant;

a means for supplying electric power to the induction heater; and a means for adjusting the quantity of heat to be produced in the rolling roller by the induction heater according to the quantity of heat that is required to be supplied to the portion of the rolling roller that is to be heated to equalize the diameter of the rolling roller;

the means for adjusting the quantity of heat including a frequency control means for adjustably controlling the frequency of the electric power that is supplied to the induction heater throughout a predetermined frequency range, wherein, when a quantity of heat is required to equalize the diameter of the portion of the rolling roller to be heated, the frequency control means adjusts the frequency of the electric power supplied to the induction heater to a frequency within the predetermined frequency range that is suitable for supplying the needed quantity of heat through the induction heater into the portion of the rolling roller to be heated.

14. An induction heating device according to claim 13, wherein the greater the quantity of heat that is required to be supplied to the portion of the rolling roller to be heated, the higher the frequency of the electric power that is supplied to the induction heater.

15. An induction heating device according to claim 14, wherein the frequency control means adjusts the frequency of the electric power that is supplied to the induction heater within a range from about 25 to 200 kHz.

16. An induction heating device according to claim 15, wherein the depth of heating of the surface of the rolling roller is about 150 $\mu$m or less.

17. An induction heating device according to claim 16, wherein the depth of heating of the surface of the rolling roller is about 100 $\mu$m or less.

18. An induction heating device according to claim 15, wherein the frequency control means adjusts the frequency of the electric power that is supplied to the induction heater within a range from about 50 to 100 kHz.

19. A method of heating a rolling roller of a rolling mill with an induction heating device so as to equalize the diameter of the rolling roller, wherein the induction heating device comprises:

an induction heater;

a means for moving the induction heater in an axial direction along the rolling roller to a portion thereof that is to be heated while maintaining the distance of the induction heater from the surface of the rolling roller substantially constant;

a means for supplying electric power to the induction heater; and a means for adjusting the quantity of heat to be produced in the rolling roller by the induction heater according to the quantity of heat that is required to be supplied to the portion of the rolling roller that is to be heated to equalize the diameter of the rolling roller;

the method of heating a rolling roller of a rolling mill comprising the step of:

adjusting the quantity of heat by means of a frequency control means for adjustably controlling the frequency of the electric power that is supplied to the induction heater throughout a predetermined frequency range, wherein, when a quantity of heat is required to equalize the diameter of the portion of the rolling roller to be heated, the frequency control means adjusts the frequency of the electric power supplied to the induction heater to a frequency within the predetermined frequency range that is suitable for supplying the needed quantity of heat through the induction heater into the portion of the rolling roller to be heated.

20. A method of heating a rolling roller of a rolling mill with an induction heating device according to claim 19, wherein the greater the quantity of heat that is required to be supplied to the portion of the rolling roller to be heated, the higher the frequency of the electric power that is supplied to the induction heater.

21. A method of heating a rolling roller of a rolling mill with an induction heating device according to claim 20, wherein the frequency control means adjusts the frequency of the electric power that is supplied to the induction heater within a range from about 25 to 200 kHz.

22. A method of heating a rolling roller of a rolling mill with an induction heating device according to claim 21, wherein the depth of heating of the surface of the rolling roller is about 150 $\mu$m or less.

23. A method of heating a rolling roller of a rolling mill with an induction heating device according to claim 22, wherein the depth of heating of the surface of the rolling roller is about 100 $\mu$m or less.

24. A method of heating a rolling roller of a rolling mill with an induction heating device according to claim 21, wherein the frequency control means adjusts the frequency of the electric power that is supplied to the induction heater within a range from about 50 to 100 kHz.

* * * * *